US006570472B1

(12) United States Patent
Niiranen

(10) Patent No.: US 6,570,472 B1
(45) Date of Patent: May 27, 2003

(54) LOW-PASS FILTER

(75) Inventor: Erkki Niiranen, Ii (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 09/605,908

(22) Filed: Jun. 28, 2000

(30) Foreign Application Priority Data

Jun. 29, 1999 (FI) ..... 991476

(51) Int. Cl.[7] ..... H01P 1/203
(52) U.S. Cl. ..... 333/204; 333/203
(58) Field of Search ..... 333/203, 204, 333/205, 207, 202

(56) References Cited

U.S. PATENT DOCUMENTS

| | | | | |
|---|---|---|---|---|
| 2,922,968 A | | 1/1960 | VanPatten | 333/73 |
| 2,964,718 A | * | 12/1960 | Packard | 333/204 |
| 3,525,954 A | * | 8/1970 | Rhode | 333/203 |
| 3,693,115 A | * | 9/1972 | Edson | 333/203 |
| 3,838,368 A | | 9/1974 | Ironfield | 333/210 |
| 4,233,579 A | * | 11/1980 | Carlson et al. | 333/204 |
| 4,437,074 A | | 3/1984 | Cohen et al. | 333/128 |
| 5,278,528 A | * | 1/1994 | Turunen | 333/203 |
| 5,352,996 A | * | 10/1994 | Kawaguchi | 333/203 |
| 6,005,455 A | * | 12/1999 | Lindell et al. | 333/134 |
| 6,078,231 A | * | 6/2000 | Pelkonen | 333/203 |

FOREIGN PATENT DOCUMENTS

| | | |
|---|---|---|
| DE | 1926501 | 11/1970 |
| DE | 2708241 B1 | 2/1977 |
| EP | 0 828 305 A1 | 3/1998 |
| FI | 87405 | 2/1990 |
| IE | XP-002149062 | 12/1986 |

* cited by examiner

*Primary Examiner*—Robert Pascal
*Assistant Examiner*—Stephen E. Jones
(74) *Attorney, Agent, or Firm*—Darby & Darby

(57) ABSTRACT

The invention comprises a high-frequency low-pass filter (200) The filter utilizes distributed capacitance and inductance elements (221–227) which are realized using a homogeneous and relatively rigid conductive part (220). The conductive part is located mainly air-insulated in an enclosed metal housing (210) which serves as a ground conductor for the signal. The housing comprises conductive partition walls (212–214) to prevent coupling between adjacent capacitive elements. The advantages of the construction include good power handling capacity, good breakdown characteristics, small losses and low manufacturing costs, among other things.

10 Claims, 4 Drawing Sheets

LOW-PASS FILTER

FIELD OF THE INVENTION

The invention relates to a high-frequency low-pass filter designed especially for radiocommunication equipment used in mobile communication networks.

BACKGROUND OF THE INVENTION

Low-pass filters in current and future mobile communication networks have to have true low-pass characteristics, i.e. their stop-band attenuation must remain relatively high up to at least 10 GHz. Good breakdown characteristics and power capacity are also often required of the filters. For example, in wideband code division multiple access (WCDMA) equipment the strength of the electric field of the transmission signal has momentary peaks that may cause breakdown in an insulator. Severe demands may be imposed on the power capacity of a low-pass filter especially in cases where several transmission signals are summed together. At least a desirable characteristic in most filters is that they have small losses. Small losses mean low attenuation on the pass band and easier matching. Moreover, as regards massproduced filters that must meet certain requirements, the question of production costs is of essence.

From the prior art it is known high-frequency low-pass filters constructed of coils and capacitors. These are useable at frequencies of up to a few GHz. At frequencies higher than that the characteristics of filters realized using said components become highly degraded due to parasitic effects in the components. The self resonances of coils and capacitors may result in considerable variation in the stop-band attenuation at high frequencies. This drawback can be alleviated by realizing the low-pass filter as a series connection of two low-pass filters such that the first filter attenuates in a certain frequency band and the second filter attenuates in a frequency band higher than that. The drawback in that case is that it affects production: the construction uses components that have very low capacitance or inductance values, and further the tolerances of these values are small.

The drawbacks caused by the self resonances of components can be alleviated by using distributed capacitance and inductance circuit elements instead of capacitors and coils. Such elements are often realized by etching them on the surface of a printed circuit board. FIG. 1*a* shows an example of a prior-art low-pass filter formed on a printed circuit board. The filter comprises conductive areas, such as 11, 12, 13 and 14, arranged in series on a printed circuit board 10 and a ground plane that may be a metal plating on the opposite surface of the circuit board or a protective housing around the circuit board. The feed line of the filter is connected between the input end IN of the conductive areas and ground, and the signal is taken out from between the output end OUT of the conductive areas and ground. Every other conductive area, such as 11 and 13, is relatively wide. What is essential in them is their capacitance in relation to the ground plane. Every other conductive area, such as 12 and 14, is relatively narrow. What is essential in them is their inductance. The equivalent circuit of the filter is thus in accordance with FIG. 1*b*. Starting from the input end it comprises inductances L1–L8 connected in series. From between the inductances capacitances C1–C7 are connected to ground. The values of the inductances and capacitances naturally depend on the dimensions of the conductive areas, which thus determine the filter's response. In practice, the filter has two parts such that the part corresponding to inductances L1–L4 and capacitances C1–C4 together with the impedance of the feeding port attenuate sufficiently from a desired cut-off frequency to a second frequency. The parts corresponding to inductances L5–L8 and capacitances C5–C7 together with the impedance of the circuit fed by the output attenuate sufficiently from said second frequency to an even higher third frequency. If the cut-off frequency of the filter in FIG. 1 is of the order of one gigahertz, the structure is drawn enlarged. The length of the individual parts in a conductive area on the printed circuit board in the direction of signal propagation is very small compared to signal wavelength. At frequencies one order of magnitude higher than the signal frequency the circuit elements should be viewed as transmission lines. Indeed the two-part nature of the filter is due to the fact that at high frequencies the first part of the filter produces transmission line resonances which decrease the stop-band attenuation.

Low-pass filters implemented on printed circuit boards are highly suitable for series production. Their drawback is that in high-power applications the power capacity of the circuit elements may prove insufficient. Another drawback is that in demanding applications the losses caused by the circuit board on the signal transferred may be too high. Still another drawback is that when feeding multiple high-frequency signals into a low-pass filter implemented on a printed circuit board, the nickel used on top of the copper in a conductive area may cause harmful intermodulation products.

SUMMARY OF THE INVENTION

An object of the invention is to reduce said disadvantages of the prior art. The filter construction according to the invention is characterized by what is expressed in the independent claim. The dependent claims disclose preferred embodiments of the invention.

The basic idea of the invention is as follows: The low-pass filter uses distributed capacitance and inductance elements. These are realized using a homogeneous and relatively thick conductive part comprising alternate inductive and capacitive elements in series. The conductive part is coated with silver, for example, and it is located mainly air-insulated in an enclosed metal housing that serves as a signal ground conductor and as a protective shield against interfering fields. The housing may have conductive partition walls in order to prevent coupling between adjacent capacitive elements. The conductive part, which forms the core of the filter, is supported to the housing through dielectric material. The ends of the housing have through holes for the input and output lines of the filter.

An advantage of the invention is that a filter according to the invention has a good power handling capacity because the conductors have relatively large cross sectional surfaces. Another advantage of the invention is that the losses of the filter are relatively low because the elements are air insulated and have relatively large cross sectional surfaces. A further advantage of the invention is that the construction according to the invention causes relatively little intermodulation because it does not use ferromagnetic coating materials and there are only a few conductor junctions. Yet another advantage of the invention is that the filter has stable characteristics. Furthermore, an advantage of the invention is that the manufacturing costs of a filter that meets certain attenuation requirements are relatively low because of the simple construction.

The invention will now be described in detail. Reference is made to the accompanying drawing wherein

DETAILED DESCRIPTION OF THE INVENTION

Figure 1A:
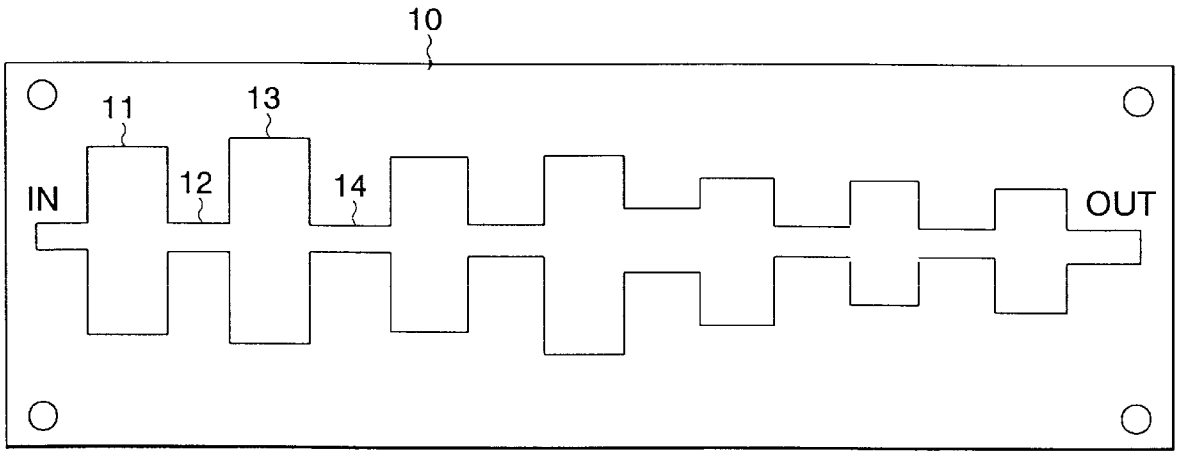
Fig. 1a (Prior Art)
FIG. 1*a* shows an example of a prior-art low-pass filter.
Figure 1B:
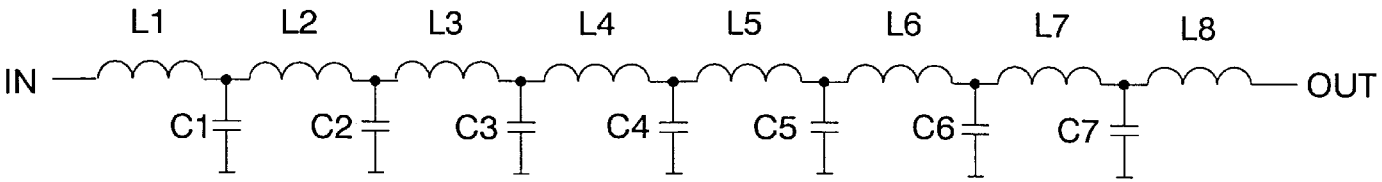
Fig. 1b (Prior Art)
FIG. 1*b* shows an equivalent circuit of the filter according to FIG. 1*a,*

FIGS. 1*a* and 1*b* were already discussed in connection with the description of the prior art.

Figure 2:
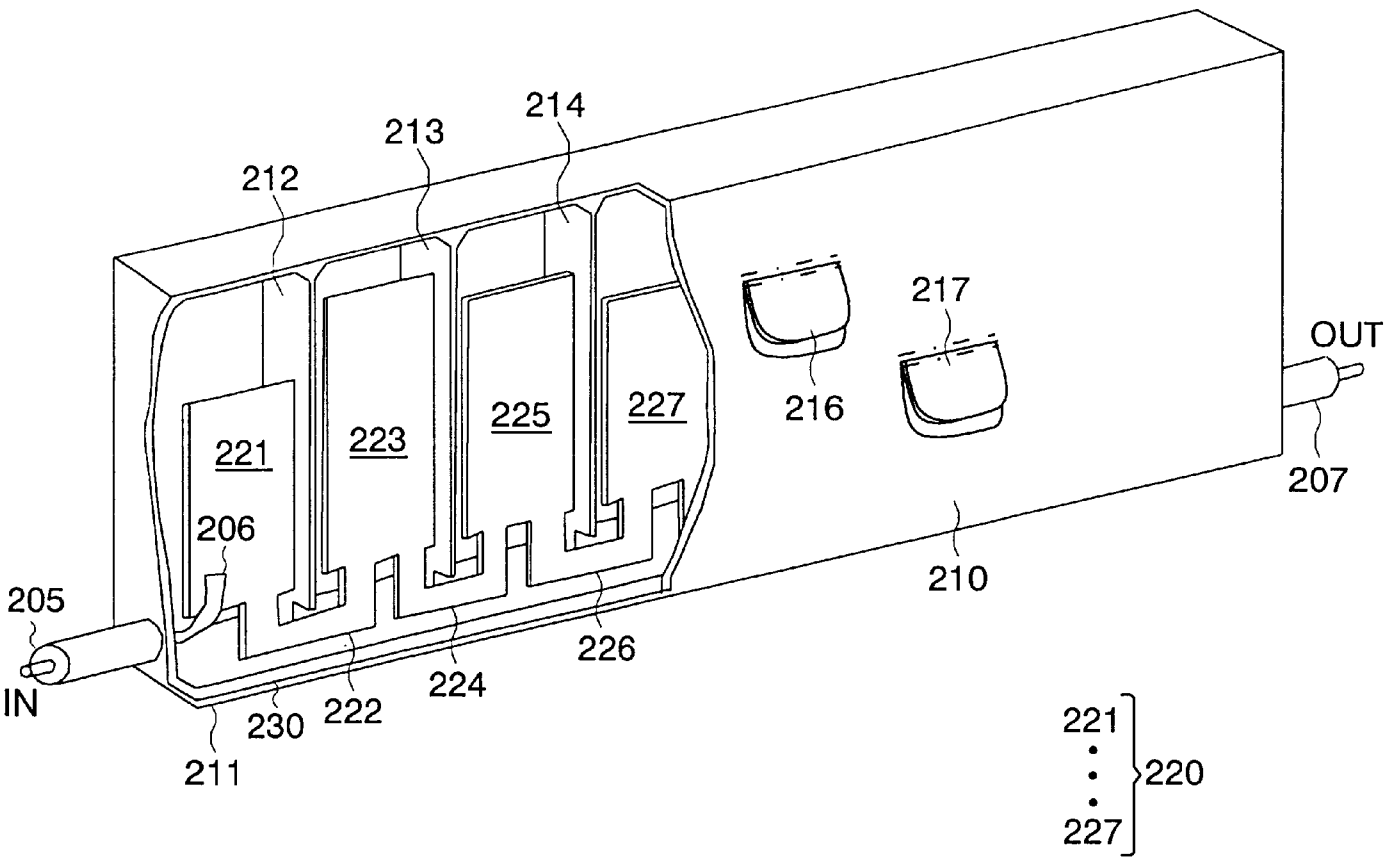
FIG. 2 shows an example of the low-pass filter according to the invention.

FIG. 2 shows an example of the low-pass filter according to the invention. The housing 210 of the filter 200 is shown partially cut open. Inside the housing there is a plate-like conductive part 220, of which there is shown elements 221, 222, 223, 224, 225, 226, and 227 located one after the other, starting from the input end IN of the filter. Elements 221, 223, 225 and 227 have a relatively large area. Their essential characteristic is their capacitance in relation to the side walls of the housing 210. Considering signal propagation, the capacitance is distributed. As the conductive part 220 is rigid, said capacitive elements do not need much support, so the insulating material around them is just air. This means relatively low losses. In between the capacitive elements 221 and 223 there is a relatively narrow plate conductor 222. It starts from near the rear edge of element 221, going first perpendicularly downwards with respect to the longitudinal direction of the filter, continuing then in parallel with the longitudinal direction and, further, perpendicularly upwards with respect to the longitudinal direction, approaching the front edge of element 223, thus forming a bend that resembles an angular U. Terms "rear edge" and "front edge" refer to the direction of propagation of the signal in the filter. In between elements 223 and 225 as well as 225 and 227 there are conductors 224 and 226, respectively, that correspond to the U conductor 222. The essential characteristic of the conductors 222, 224 and 226 is their inductance. In practice the inductive elements are connected in series through the lower parts of the capacitive elements. Thus is formed a low-pass construction that has inductance in the longitudinal direction and capacitance in the crosswise direction, i.e. from between the inductances to the signal ground. The value of each individual capacitance and inductance depends on the dimensions of the conductive part 220. Thus it is possible to realize the desired transfer function and frequency response in the filter.

The length of the filter housing allows for a total of eight capacitive elements in the exemplary construction shown in FIG. 2. If the construction is made such that the last element is an inductive element, there are eight inductive elements, too. If the filter were realized as a single filter, its order would be 16. Then, however, at frequencies high compared to the cut-off frequency there might occur transmission line resonances resulting in that the theoretical stop-band attenuation corresponding to the order would not be achieved in practice. Therefore it is advisable to realize the filter in two parts such that it comprises two $8^{th}$-order low-pass filters in succession. The cut-off frequency of the first part is set so as to equal the desired cut-off frequency of the whole filter. The cut-off frequency of the second part is set such that the second part attenuates effectively at frequencies at which the resonances of the first part degrade the stop-band attenuation. This arrangement would correspond to that shown in FIG. 3.

In the example of FIG. 2 the inductive elements and thus the whole conductive part 220 rest on an insulating board 230 placed on top of the bottom plate 211 of the filter housing. Where necessary, small additional supports may be used. Coaxial input line 205 and output line 207 can be seen in the Figure. The outer conductor of the input line is galvanically coupled to an end of the filter housing 210, and the inner conductor is likewise galvanically coupled to the capacitive element 221 through conductor 206. The filter housing includes conductive partition walls. Between elements 221 and 223 there is wall 212, between elements 223 and 225 there is wall 213, and between elements 225 and 227 there is wall 214. The partition walls prevent electromagnetic coupling between the capacitive elements. Shown on the front wall of the filter housing there are two bendable flaps 216 and 217. They are used to tune the filter.

Figure 3:
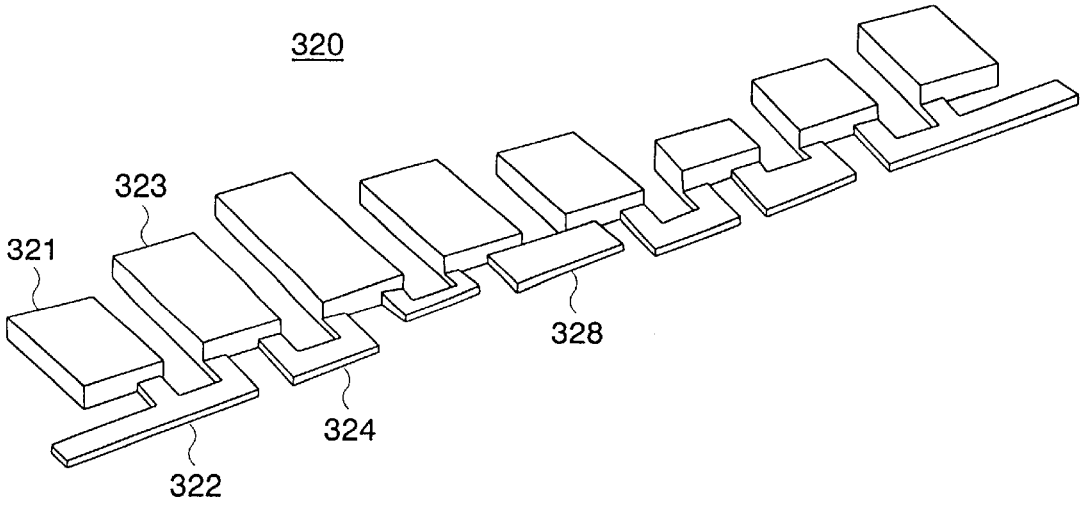
FIG. 3 shows a second example of the low-pass filter according to the invention.

FIG. 3 shows a second example of the core part of the filter according to the invention, i.e. the conductive part having distributed capacitances and inductances. The conductive part 320 comprises eight relatively wide plates, such as 321 and 322, which in the complete construction function as capacitive elements. In addition, the conductive part 320 comprises seven relatively narrow plates, such as 322 and 324, which interconnect the capacitive elements and function as inductive elements. It differs from the conductive part 220 shown in FIG. 2 in that the capacitive elements are now thicker than the inductive elements. Because of that, the distance of a capacitive element from the ground plane is smaller and the capacitance greater than in the case of an equal-sized construction in which the thickness is invariable. The part becomes more difficult to manufacture but it has the advantage that the filter occupies less room.

The low-pass filter to which the conductive part of FIG. 3 belongs is meant to include two portions as described above. Therefore, the inductive element 328 in the middle of the construction is wider and shorter and connects to the capacitive elements through a larger cross section than the other inductive elements. The inductance is then very low. The element 328 thus provides for a very low-impedance path from the first portion of the filter to the second.

Figure 4:
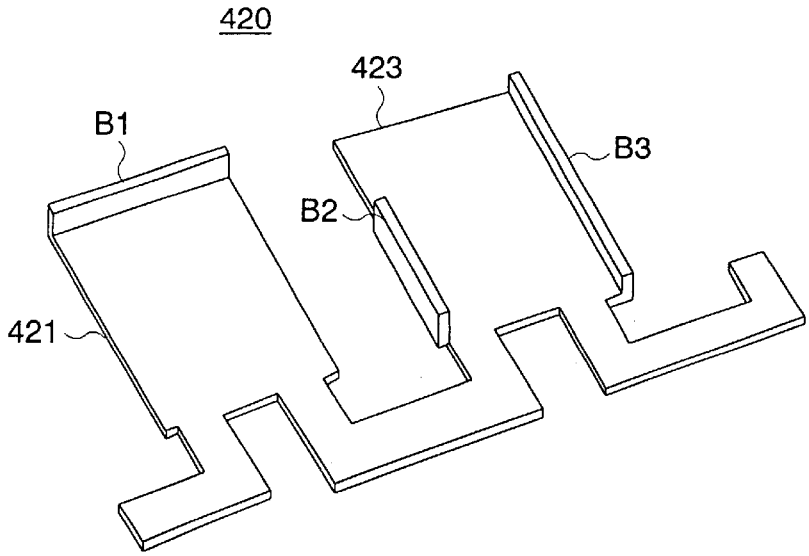
FIG. 4 shows a third example of a low-pass filter according to the invention.

FIG. 4 shows a third example of the core part of the filter according to the invention. The Figure shows two capacitive elements 421 and 423 in a conductive part 420, and inductive elements in connection with these. The Figure only illustrates the principle. Characteristic of the construction are the projections in the plates representing capacitive elements, created e.g. by bending. There is such a bend B1 at the upper end of element 421. Similarly, there is a bend B2 on the left side of element 423 and bend B3 on the right side. By selecting the location, length and height of the bend the capacitance can be set precisely as desired. The bends also strengthen the construction.

Figure 5:
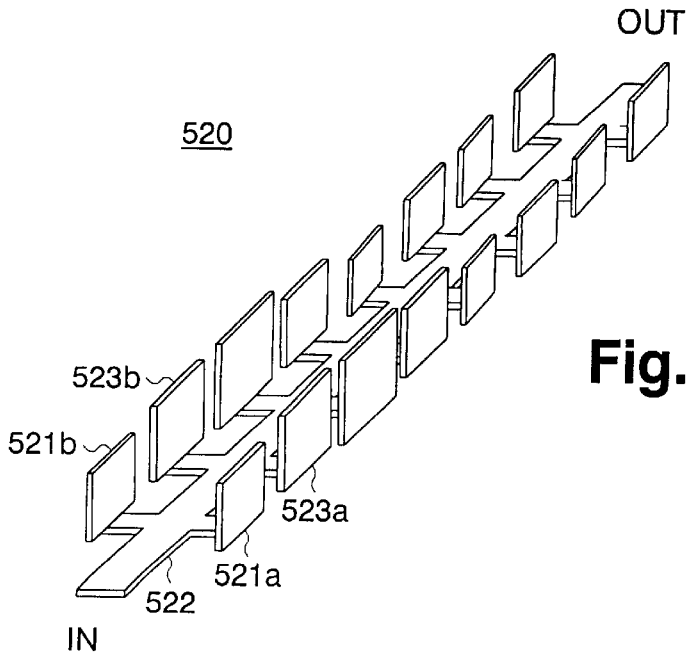
FIG. 5 shows a fourth example of the low-pass filter according to the invention.

FIG. 5 shows a fourth example of the core part of the filter according to the invention. In the middle there is a horizontal straight conductor 522, longitudinal regarding the filter. It has an inductance distributed evenly over the length of the conductor. Near the input end IN two transversal and horizontal, relatively short conductors branch from the conductor 522 in opposite directions. These two conductors then become wider vertical conductors 521*a* and 521*b* which are longitudinal on one side. In a complete construction the conductive plate 521*a* is close to the front wall of the filter housing, for instance, and conductive plate 521*b* is close to the rear wall. Said conductive plates thus form a significant capacitance with respect to the signal ground. Since, circuitwise, the conductive plates 521*a* and 521*b* are in parallel, the equivalent circuit of the filter shows the sum of their capacitances. Further on along the conductor 522 there is a second similar branching point and conductive plate pair 523*a*, 523*b* and then, one after the other, six more conductive plate pairs in connection with the conductor 522. So, in this example, too, the construction includes eight capacitive elements with inductance in between them. Only, in this case the capacitive elements have two parts. As all the parts in the construction shown in FIG. 5 have the same thickness, the manufacture of the construction is simple. It has the advantage that the filter can be realized relatively small.

Figure 6:
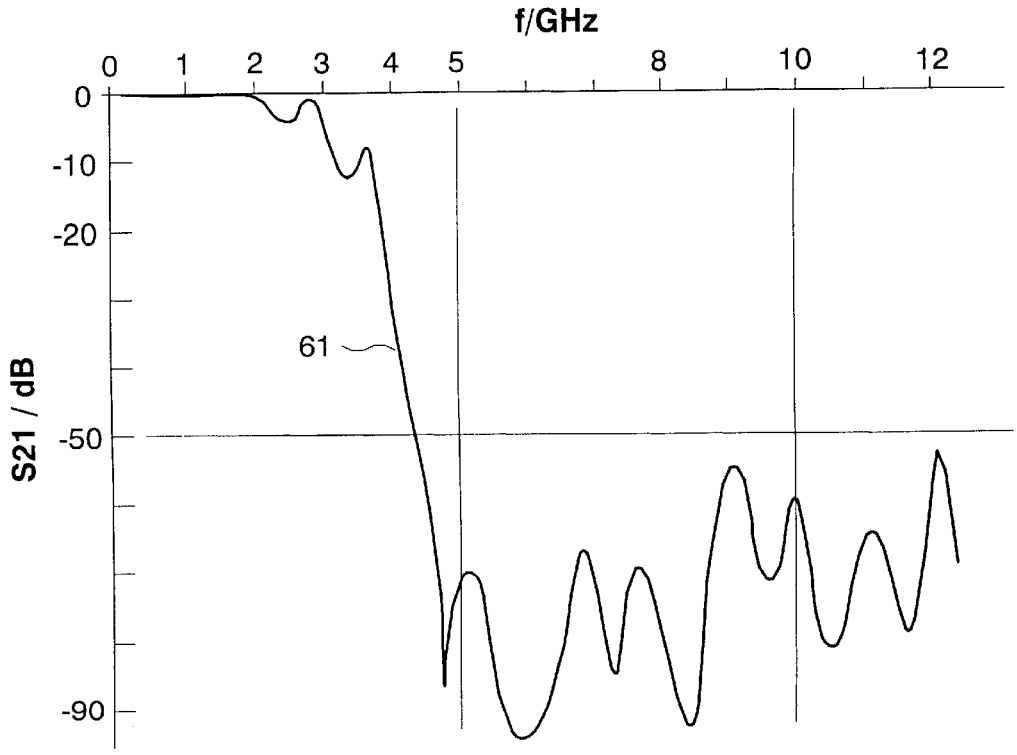
FIG. 6 shows an example of the response of the low-pass filter according to the invention.

FIG. 6 shows an example of the amplitude response of a low-pass filter constructed in accordance with the invention. The vertical axis represents parameter S21, i.e. signal attenuation in the filter. The variable on the horizontal axis is frequency. The pass band is meant to reach the frequency of about 2 GHz; the carrier frequency of the assumed system is in the range of 1.92–1.98 GHz. Curve 61 shows that the attenuation at twice the carrier frequency is about 25 dB, and from 4.4 GHz up till at least 13 GHz the attenuation is more than 50 dB. At three times the carrier frequency the attenuation is especially high.

Solutions according to the invention were described above. The invention is not limited to them. The conductive part that produces the inductances and capacitances of the filter may vary greatly in its form. Furthermore, the successive elements need not be located on the same straight line; the construction may comprise a U-bend such that the filter input and output are at the same end of the housing. The inventional idea may be applied in many ways within the scope defined by the independent claim.

What is claimed is:

1. A low-pass filter comprising an electrically conductive housing and therein successive elements of distributed reactance, said successive elements being alternately, capacitive and inductive, characterized in that said elements form a homogeneous conductive part (220; 320; 420; 520) which is substantially air-insulated and is wholly isolated from said housing (210), and that said housing (210) forms a ground plane for the signal path in the filter, wherein only the inductive elements of the conductive part (220; 320; 420; 520) rest on an insulating part (230) in said housing (210).

2. The construction of claim 1, characterized in that said conductive part (220) is substantially planar.

3. The construction of claim 1, characterized in that the capacitive elements in said conductive part (320) are substantially thicker and closer to the filter's ground plane than the inductive elements.

4. The construction of claim 1, characterized in that at least one capacitive element in said conductive part comprises two electrically parallel portions, the first portion (521*a*) of which forms a capacitance substantially with a first wall of said housing, and the second portion (521*b*) forms a capacitance substantially with a wall opposite to the first wall of the housing.

5. The construction of claim 1, characterized in that at least one capacitive element (423) in said conductive part comprises a substantially rectangular plate parallel to the ground plane, in which the plate has on at least one side a projection (B2, B3) that substantially deviates from the plane of the plate.

6. The construction of claim 1, characterized in that said housing (210) comprises at least one conductive partition wall (212, 213, 214) between adjacent capacitive elements.

7. The low-pass filter of claim 1, characterized in that the inner conductor of its input line (205) is galvanically (206) coupled to the first capacitive element (221) of said conductive part.

8. The construction of claim 7, characterized in that said conductive part is supported by the filter's input and output conductors.

9. The low-pass filter of claim 1, characterized in that it comprises a first and a second part connected in series, the cut-off frequency of the first part being the same as that of the whole low-pass filter, and the cut-off frequency of the second part being substantially higher than that of the first part.

10. A low-pass filter comprising an electrically conductive housing and therein successive elements of distributed reactance, said successive elements being, alternately, capacitive and inductive, characterized in that said elements form a homogenous conductive part (220; 320; 420; 520) which is substantially air-insulated and is wholly isolated from said housing (210), and that said housing (210) forms a ground plane for the signal path to the filter, wherein the longitudinal edge of said conductive part rests on a dielectric board (230) located on an inner side of said housing.

* * * * *